US006350170B1

(12) United States Patent
Liu

(10) Patent No.: US 6,350,170 B1
(45) Date of Patent: Feb. 26, 2002

(54) SWINGING STRUCTURE FOR A MECHANICAL ANIMAL

(76) Inventor: Da-Ming Liu, 5F., No. 13, Pao Kao Road, Hsin Tien, Taipei Hsien (TW)

( * ) Notice: Subject to any disclaimer, the term of this patent is extended or adjusted under 35 U.S.C. 154(b) by 0 days.

(21) Appl. No.: 09/756,769

(22) Filed: Jan. 10, 2001

(51) Int. Cl.[7] ..... A63H 11/00; A63H 13/00

(52) U.S. Cl. ..... 446/353; 446/330; 446/352; 446/355; 446/358

(58) Field of Search ..... 446/353, 330, 446/352, 355, 358, 370, 371, 373, 375, 376

(56) References Cited

U.S. PATENT DOCUMENTS 4,224,759 A * 9/1980 Saint-Pierre et al. ..... 446/353
4,419,841 A * 12/1983 Huang ..... 446/353
4,813,908 A * 3/1989 Oikawa et al. ..... 446/353
4,913,676 A * 4/1990 Koguchi et al. ..... 446/330

* cited by examiner

*Primary Examiner*—Jacob K. Ackun, Jr.
*Assistant Examiner*—Shaquita M McConnell
(74) *Attorney, Agent, or Firm*—Bacon & Thomas, PLLC

(57) ABSTRACT

A swinging structure for a mechanical animal includes a housing and a shell. The housing has disposed therein a shaft and a rod. The shaft has an eccentric wheel and a worm gear mounted thereon. The rod is provided with a worm that engages the worm gear. The outer wall of the shaft is provided with at least one post. These posts are fitted with a T-shaped actuated plate. The end of the actuated plate that is connected to the posts is provided with an elongated groove. The opposite end thereof is provided with a pin. The other side of the elongated groove is provided with a notch that can just accommodate the outer edge of the eccentric wheel. The shell is provided with an actuated rod corresponding to the pin. When the eccentric wheel rotates, due to the notch that moves along the outer edge of the eccentric wheel, the actuated plate can oscillate within the elongated groove thereof, and the pin thereon can actuate the actuated rod to cause the shell to oscillate.

3 Claims, 3 Drawing Sheets

SWINGING STRUCTURE FOR A MECHANICAL ANIMAL

BACKGROUND OF THE INVENTION (a) Field of the Invention

The present invention relates to a swinging structure for a mechanical animal, more particularly to a swinging structure that is adapted to be disposed inside a mechanical toy animal, that is simple in construction, that can enable the mechanical animal to perform predetermined actions in a lively and realistic manner and to adjust the center of gravity thereof with the swinging of the swinging structure so as to achieve real-life actions.

(b) Description of the Prior Art

Toy animals available in the marketplace are generally stationary for viewing purposes. With the advancement of technology and in view of the trend for variety, mechanical or action animal figures have been developed.

There are some drawbacks associated with the conventional mechanical toy animals. In general, an actuating coupling structure is disposed inside the mechanical animal. However, the structural elements thereof are many and complicated, as well as costly to manufacture. Malfunctioning of any one structural element will result in affected operation of the mechanical animal. Furthermore, the actions of the conventional mechanical animals are rigid and not life-like.

SUMMARY OF THE INVENTION

The object of the present invention is to provide a swinging structure for a mechanical animal that is simple in construction, and that can enable the mechanical animal to perform predetermined actions and movements in a realistic and lively manner. The swinging structure can also enable the mechanical device to adjust the center of gravity thereof with the swinging of the buttocks (a shell) so as to produce cute and life-like movements.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
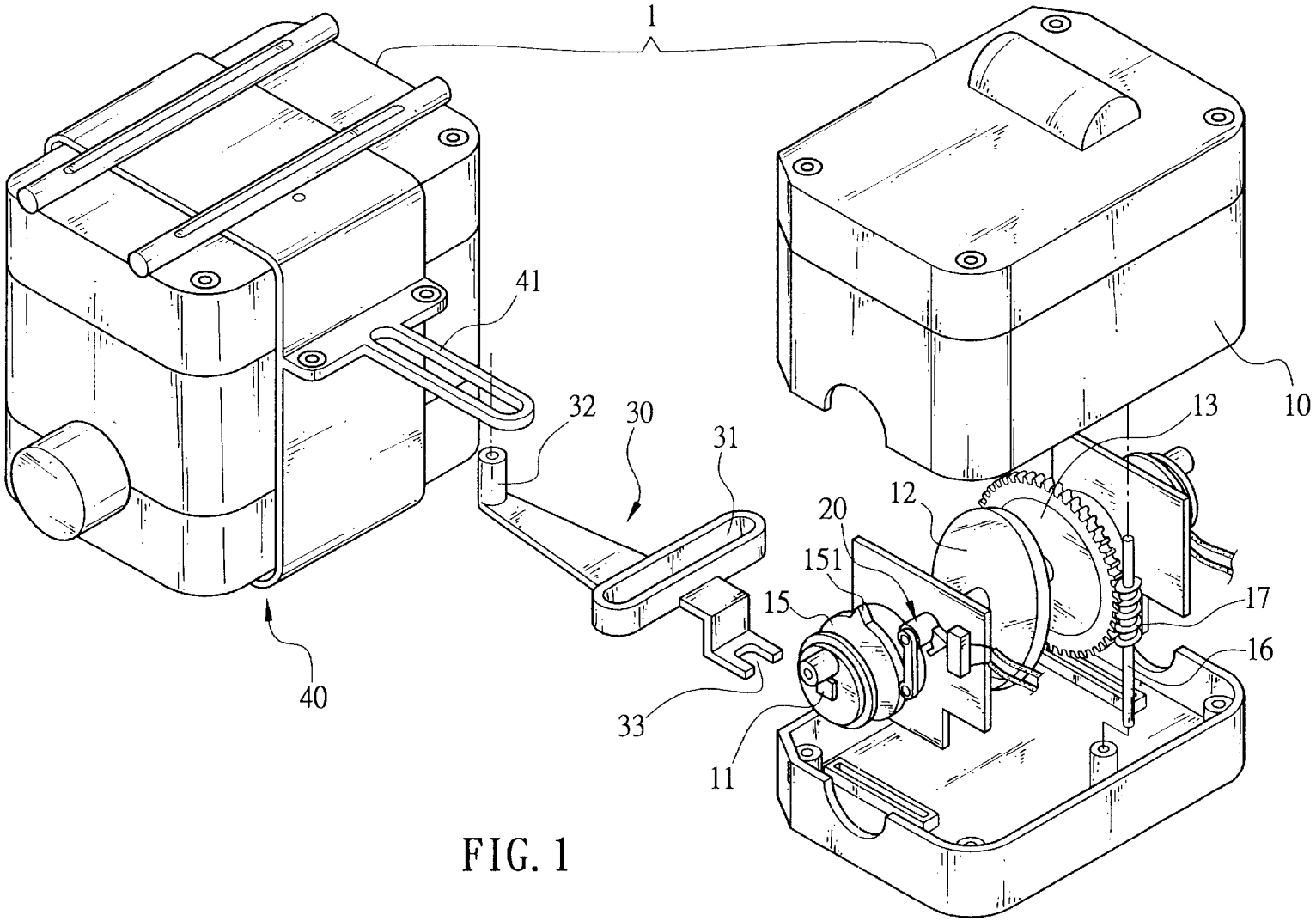
FIG. 1 is an exploded perspective view of the present invention.
Figure 2:
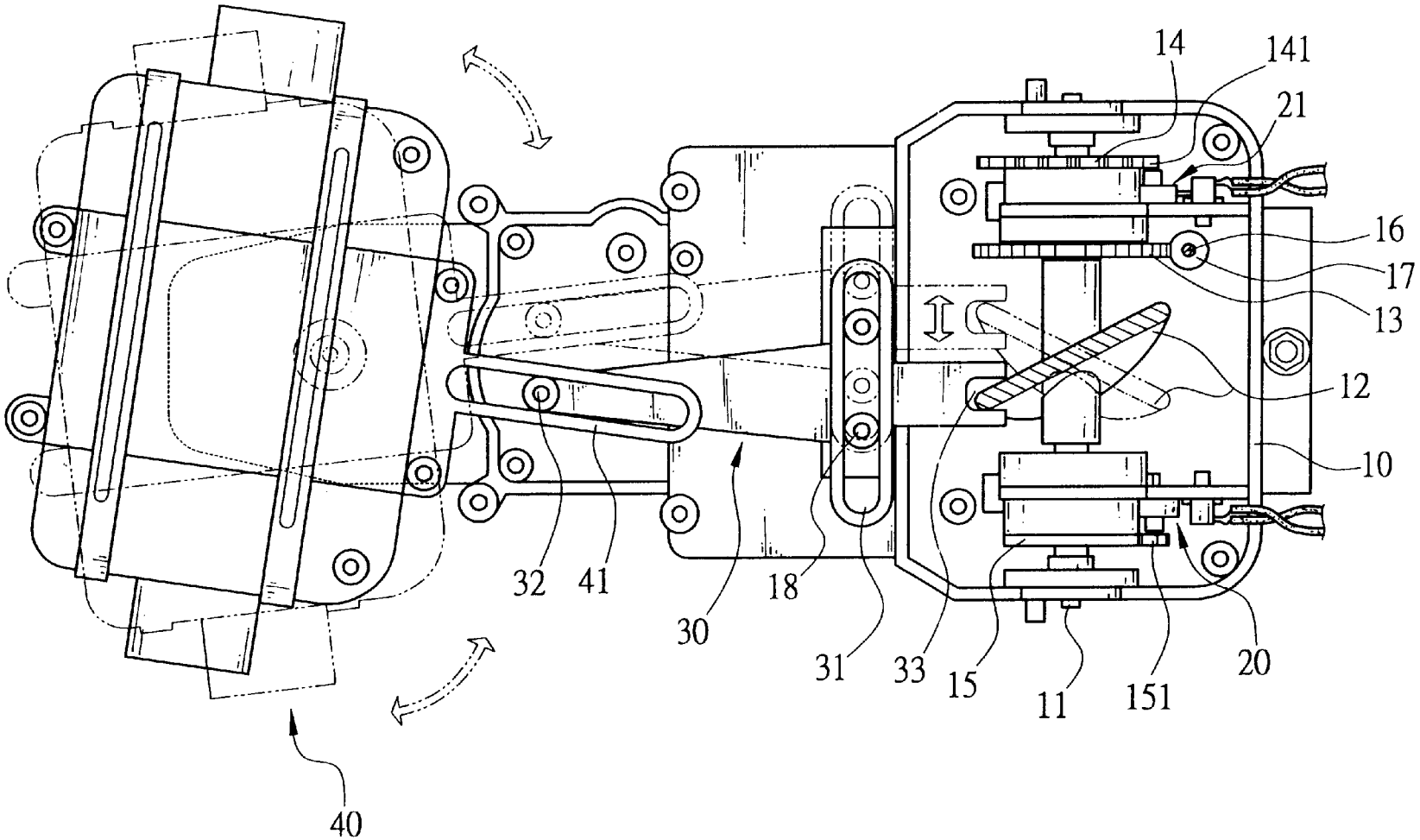
FIG. 2 is an assembled top view illustrating operation of the present invention.
Figure 3:
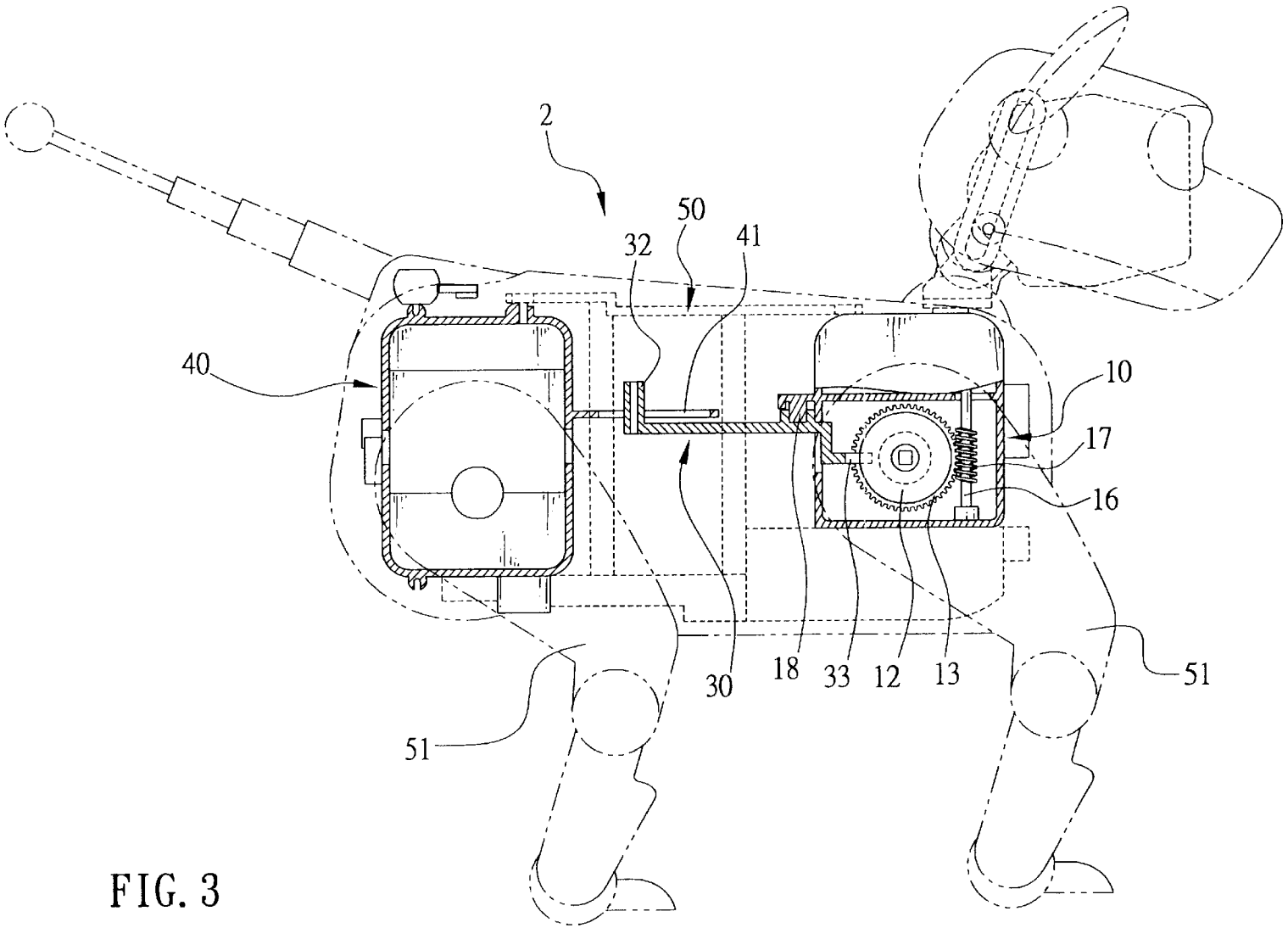
FIG. 3 is a schematic side view of the present invention when applied to a mechanical dog.

With reference to FIGS. 1, 2 and 3, a swinging structure for a mechanical animal according to this invention is adapted for application to a mechanical animal 2 (such as a mechanical cat, a mechanical dog, etc.) such that actions and movements of the mechanical animal are realistic and cute like real ones.

Referring to FIG. 1, the swinging structure 1 of this invention is shown to include a housing 10. The housing 10 has a receiving chamber transversely provided with a shaft 11. The shaft 11 has an eccentric wheel 12, a worm gear 13, a toothed wheel 14, and a round disk 15 sleeved thereon. The eccentric wheel 12 is adjacent to the intermediate section of the shaft 11. The worm gear 13 and the toothed wheel 14 are provided at one end of the shaft 11, whereas the round disk 15 is provided at the other end of the shaft 11.

In this invention, the housing 10 has a rod 16 disposed in the receiving chamber thereof. The rod 16 is disposed perpendicular to the shaft 11, and has a worm 17 sleeved thereon. The worm 17 is disposed to engage the worm gear 13 such that when a transmission device (not shown) provided at one end of the rod 16 is actuated, the worm 17, worm gear 13, eccentric wheel 12, toothed wheel 14, and round disk 15 can be brought to rotate relative thereto.

The outer edge of the round disk 15 is provided with at least a projection 151 such that when the round disk 15 has rotated a certain distance, the projection 151 on the round disk 15 and the teeth 141 on the toothed wheel 14 may respectively contact two signal elements 20, 21 (as shown in FIGS. 1 and 2). Through the contact of the projection 151 and the teeth 141 with the two signal elements 20, 21, the four limbs of the mechanical animal 2 can perform different predetermined actions, such as hold hands, squatter, retract, etc.

The outer wall of the housing 10 proximate to the eccentric wheel 12 is provided with at least one post 18. A T-shaped actuated plate 30 is fitted on the posts 18 (as shown in FIGS. 1 and 2). The actuated plate 30 is formed with an elongated groove 31 at one end that is connected to the posts 18. The other end of the actuated plate 30 extends substantially perpendicular to the elongated groove 31 and is provided with a pin 32. The other side of the elongated groove 31 is provided with a notch 33 extending therefrom and being substantially perpendicular thereto. The notch 33 may just accommodate the outer edge of the eccentric wheel 12 (as shown in FIG. 2) such that when the eccentric wheel 12 is actuated, the notch 33 may move along the outer edge of the eccentric wheel 12 so that the actuated plate 30 can oscillate within the elongated groove 31.

The invention further includes a shell 40 with an outer wall provided with an actuated rod 41 corresponding to the pin 32 of the actuated plate 30. The actuated rod 41 is in the form of an elongated groove disposed substantially perpendicular to the elongated groove 31 of the actuated plate 30. When the actuated plate 30 oscillates in the elongated groove 31 thereof, the pin 32 may actuate the actuated rod 41 along the elongated groove thereof so that the shell 40 may perform left and right oscillation (see FIG. 2).

With reference to FIG. 3, which shows a preferred embodiment of this invention, the mechanical animal 2 may be in the form of a mechanical dog, and the swinging structure 1 is provided on a frame 50 disposed inside the mechanical dog. The shell 40 serves as the buttocks of the mechanical dog.

By virtue of the swinging structure 1 of this invention, which is simple in construction, four limbs 51 of the mechanical dog can perform predetermined actions in a lively and realistic manner. Besides, the buttocks (the shell 40) of the mechanical dog can swing left and right to adjust the center of gravity of the mechanical dog so that the mechanical dog moves like a real dog. Thus, the drawbacks associated with the prior art are overcome.

Although the present invention has been illustrated and described with reference to the preferred embodiment thereof, it should be understood that it is in no way limited to the details of such embodiment but is capable of numerous modifications within the scope of the appended claims.

What is claimed is:

1. A swinging structure for a mechanical animal adapted for use to facilitate swinging movements of mechanical animals of any shape, said swinging structure comprising:

a housing having a receiving chamber in which a shaft and a rod are disposed, said rod being disposed substantially perpendicular to said shaft;

an eccentric wheel provided on said shaft adjacent to an intermediate section thereof;

a worm gear provided on said shaft and to one side of said eccentric wheel;

a worm provided on said rod and engageable with said worm gear such that when a transmission device provided at one end of said rod is actuated, said worm, said worm gear and said eccentric wheel can be brought to rotate relative thereto;

at least one post provided on an outer wall of said housing proximate to said eccentric wheel;

a T-shaped actuated plate having one end in the form of an elongated groove fitted on said at least one post and the other end extending substantially perpendicular to said elongated groove and provided with a pin, the other side of said elongated groove extending substantially perpendicular and provided with a notch that can just accommodate an outer edge of said eccentric wheel;

a shell having an outer wall provided with an actuated rod corresponding to said pin of said actuated plate, said actuated rod being in the form of an elongated groove and disposed substantially perpendicular to said elongated groove of said actuated plate;

whereby said swinging structure is adapted to be disposed on a frame of a the mechanical animal such that when said eccentric wheel rotates, through said notch that moves along said outer edge of said eccentric wheel, said actuated plate can oscillate within said elongated groove thereof so that said pin on said actuated plate can actuate said actuated rod along said elongated groove thereof to cause said shell to perform left and right oscillation.

2. The swinging structure for a mechanical animal according to claim 1, wherein one end of said shaft is provided with a toothed wheel such that after said toothed wheel has rotated a certain distance, the teeth thereon can contact a corresponding signal element to cause the mechanical animal to perform predetermined actions.

3. The swinging structure for a mechanical animal according to claim 1, wherein the other end of said shaft is provided with a round disk, the outer edge of said round disk being provided with at least one projection that can, after said round disk has rotated a certain distance, contact a corresponding signal element to cause the mechanical animal to perform predetermined actions.

* * * * *